US005655975A

United States Patent [19]

Nashif

[11] Patent Number: 5,655,975

[45] Date of Patent: Aug. 12, 1997

[54] GOLD CLUB HAVING VIBRATION DAMPING DEVICE AND METHOD FOR MAKING SAME

[75] Inventor: Ahid D. Nashif, Cincinnati, Ohio

[73] Assignee: Roush Anatrol, Inc., Sunnyvale, Calif.

[21] Appl. No.: 551,989

[22] Filed: Nov. 2, 1995

Related U.S. Application Data

[63] Continuation-in-part of Ser. No. 484,450, Jun. 7, 1995.

[51] Int. Cl.[6] ..... A63B 53/10

[52] U.S. Cl. ..... 473/316; 473/318; 428/36.9; 273/DIG. 8

[58] Field of Search ..... 473/316, 317, 473/318, 319, 320, 321, 322, 323; 273/DIG. 23, DIG. 3, DIG. 8, DIG. 22, 73 F, 75, 72 A, 67 R, 67 A; 156/187, 145; 428/364, 375, 36.9

[56] References Cited

U.S. PATENT DOCUMENTS

| | | | |
|---|---|---|---|
| 1,169,667 | 6/1916 | Meguyer . | |
| 1,688,473 | 10/1928 | Sippel . | |
| 1,777,822 | 10/1930 | Barrett . | |
| 1,894,706 | 1/1933 | Reach . | |
| 1,894,707 | 1/1933 | Reach . | |
| 1,906,239 | 5/1933 | Reach . | |
| 1,946,007 | 2/1934 | Watson . | |
| 1,953,604 | 4/1934 | Heller . | |
| 1,968,616 | 7/1934 | Oldham . | |
| 1,980,408 | 11/1934 | Jansky . | |
| 2,023,131 | 12/1935 | Gibson . | |
| 2,085,915 | 7/1937 | MacCallum . | |
| 2,099,319 | 11/1937 | Shaw . | |
| 2,129,068 | 9/1938 | Reach . | |
| 3,075,768 | 1/1963 | Karns . | |
| 3,762,707 | 10/1973 | Santorelli | 473/318 |
| 3,764,137 | 10/1973 | Petro . | |
| 3,972,529 | 8/1976 | McNeil . | |
| 4,023,801 | 5/1977 | VanAuken . | |
| 4,044,625 | 8/1977 | D'Haem et al. . | |
| 4,415,156 | 11/1983 | Jorgensen . | |
| 4,541,631 | 9/1985 | Sasse . | |
| 4,674,746 | 6/1987 | Benoit . | |
| 4,725,060 | 2/1988 | Iwanaga . | |
| 4,736,949 | 4/1988 | Muroi . | |
| 4,836,545 | 6/1989 | Pompa . | |
| 4,951,953 | 8/1990 | Kim . | |
| 4,979,743 | 12/1990 | Sears . | |
| 5,049,422 | 9/1991 | Honma . | |
| 5,083,780 | 1/1992 | Walton et al. . | |
| 5,180,163 | 1/1993 | Langtot | 273/72 A |
| 5,203,561 | 4/1993 | Lanctot . | |
| 5,236,198 | 8/1993 | Haines et al. . | |

(List continued on next page.)

FOREIGN PATENT DOCUMENTS

| | | |
|---|---|---|
| 2575393 | 7/1986 | France . |
| 2-31770 | of 1990 | Japan . |
| 6339551 | 12/1994 | Japan . |
| 13337 | 6/1912 | United Kingdom . |
| 499155 | 1/1939 | United Kingdom . |
| 2053004 | 2/1981 | United Kingdom . |
| 2053698 | 2/1981 | United Kingdom . |
| 2146906 | 5/1985 | United Kingdom . |
| 2226380 | 6/1990 | United Kingdom . |
| 2227418 | 8/1990 | United Kingdom . |
| 2259861 | 3/1993 | United Kingdom . |

OTHER PUBLICATIONS

Publication: "Good Vibrations", Golf Digest, Mar. 1995, pp. 70–72.

*Primary Examiner*—Sebastiano Passaniti
*Attorney, Agent, or Firm*—Bliss McGlynn, P.C.

[57] ABSTRACT

A golf club having a vibration damping device including a club head, a shaft connected to the club head having resonant frequencies over a predetermined range and a rod disposed within the shaft with a viscoelastic material interposed between the shaft and the rod. The rod is flexible and has resonant frequencies over the same frequency range as the shaft such that the shaft and rod vibrate out of phase with respect to each other and thereby deform the viscoelastic material to damp vibrations in the shaft.

17 Claims, 4 Drawing Sheets

U.S. PATENT DOCUMENTS 5,269,516 12/1993 Janes .
5,277,423 1/1994 Artus .
5,294,118 3/1994 Iwanaga .
5,294,119 3/1994 Vincent et al. .
5,297,791 3/1994 Negishi .
5,314,180 5/1994 Yamagishi et al. .
5,316,300 5/1994 Simmons .
5,322,280 6/1994 Wu .
5,362,046 11/1994 Sims .
5,398,934 3/1995 Soong .
5,421,574 6/1995 Yamagishi et al. .
5,439,219 8/1995 Vincent .
5,467,984 11/1995 Veux et al. .
5,478,075 12/1995 Saia et al. .

FIG 1
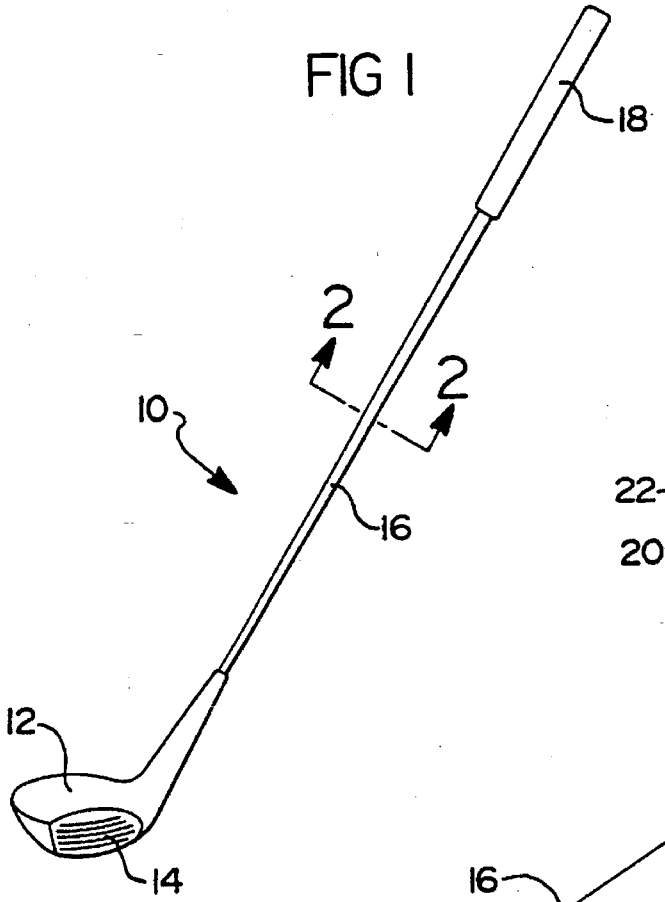
FIG 2
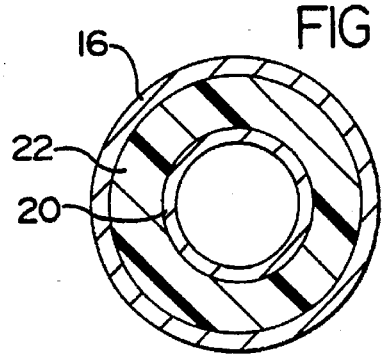
FIG 3
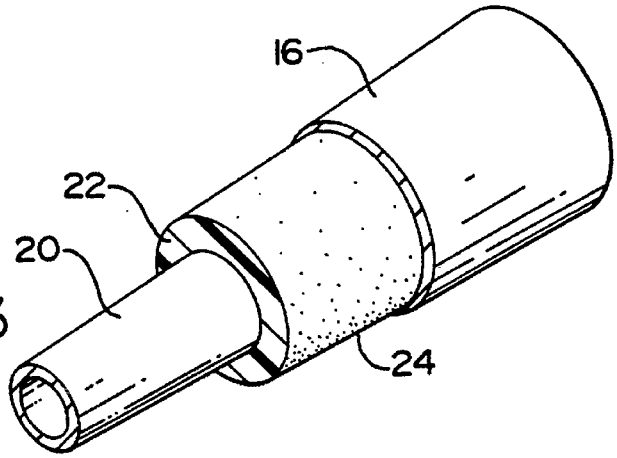
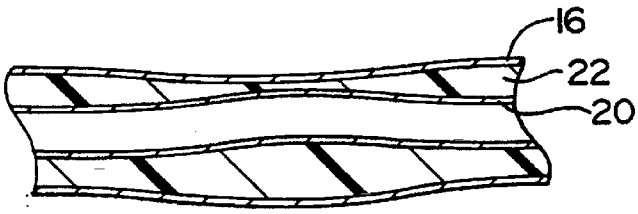
FIG 4

FIG 5
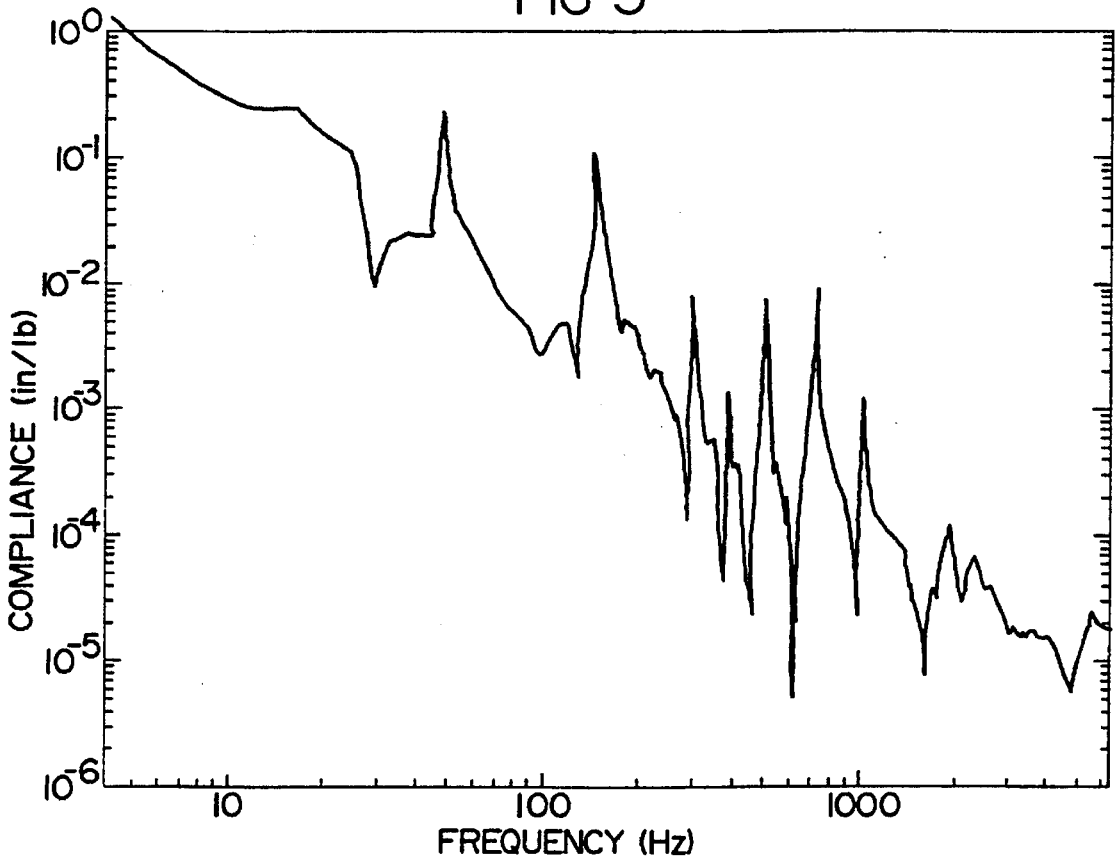
FREE-FREE RESPONSE OF SHAFT ONLY
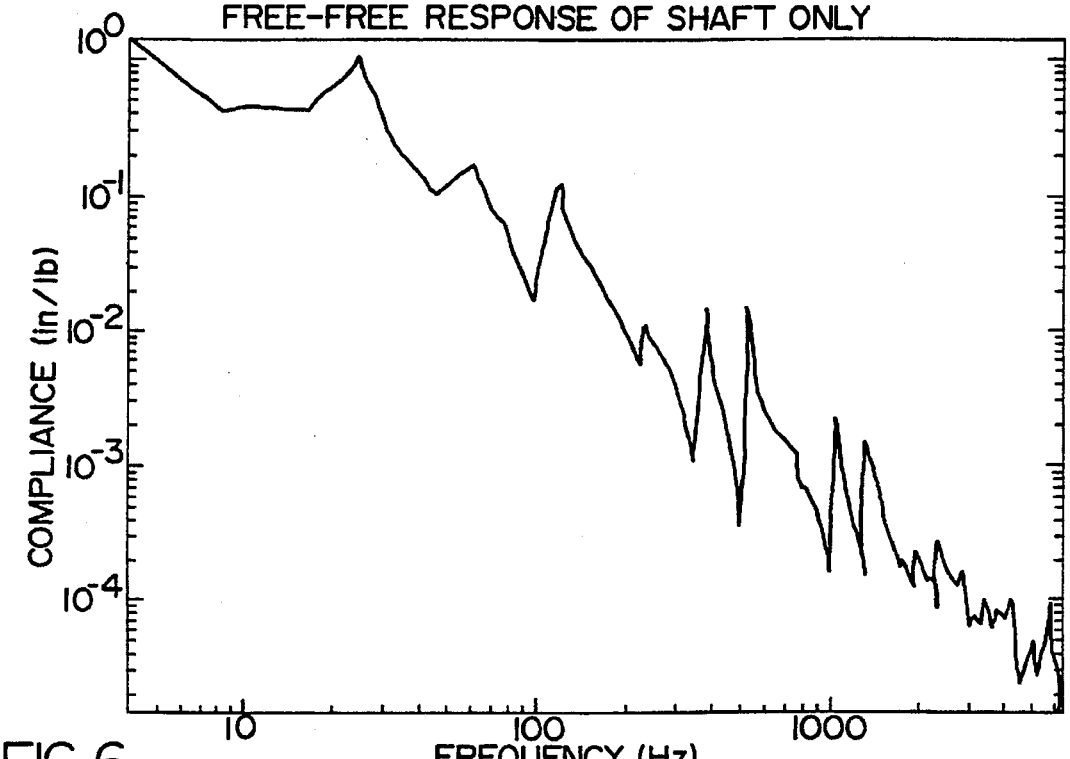
FIG 6
FREE-FREE RESPONSE OF A FLEXIBLE ROD EFFECT OF THE DAMPING DEVICE ON THE RESPONSE OF A TYPICAL GOLF CLUB SHAFT IN A FREE-FREE CONFIGURATION EFFECT OF THE DAMPING DEVICE ON THE RESPONSE OF A TYPICAL GOLF CLUB IN A HAND-HELD CONFIGURATION FIG 9
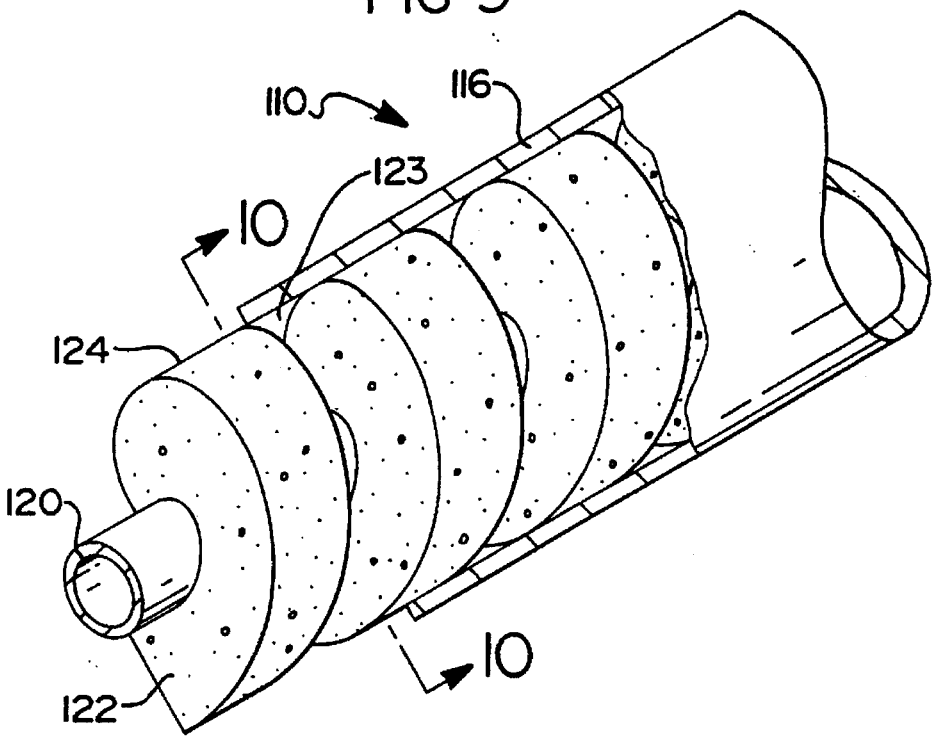
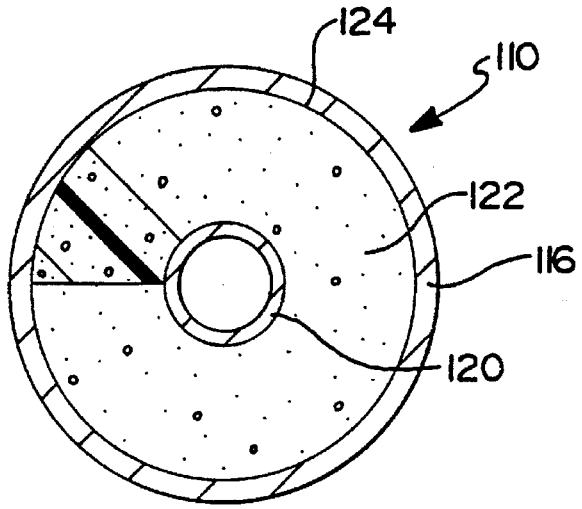
FIG 10

GOLD CLUB HAVING VIBRATION DAMPING DEVICE AND METHOD FOR MAKING SAME

CROSS-REFERENCE TO RELATED APPLICATION(S)

The present application is a continuation-in-part of U.S. Ser. No. 08/484,450, filed Jun. 7, 1995.

BACKGROUND OF THE INVENTION

1. Field of the Invention

The present invention relates generally to a golf club having a vibration damping device and method for making same and, more specifically, to a light weight golf club having a flexible vibration damping device incorporated therein and a method for making same which damps vibrations over a broad range of frequencies.

2. Description of the Related Art

In the game of golf, a club is used to strike a stationary ball, driving it along a course with the object of placing the ball in a hole in the shortest number of strokes. Golf clubs come in a number of varieties, most prominently distinguished by the shape of the head. A shaft is attached at one end to the head and typically includes a grip at the opposite end of the shaft. Club heads may be generally categorized as "woods," "irons," and "putters" as is commonly known in the art. The impact of the ball on the hitting surface or face of the club generates vibratory phenomena on the shaft of the club. When the ball is hit perfectly, this vibratory phenomena is not objectionable to the player and may even be pleasant, creating a distinctive sound indicating that the ball was well struck in the "sweet spot" of the club face.

On the other hand, when the ball is not hit perfectly at dead center of the "sweet spot" on the club face, torsional and bending forces are introduced to the club. These forces result in unfavorable vibratory phenomena having multiple resonant frequencies to 5,000 Hz and sometimes higher. These vibrations are transmitted to the golfer through his/her hands and can be very unpleasant. Such unpleasant experiences can have a negative effect on the players and thereby decrease the enjoyment of the game of golf.

There have been numerous attempts to address and reduce the above problem. For example, one attempt to address the above problem has been to provide vibration damping devices which are designed to specific type of modes of vibration over a limited frequency range. Such vibration damping devices rely on the constrained layer damping principle wherein a viscoelastic material is disposed between a stiff, rigid plate or member and the shaft to be damped. Vibrations cause the stiff, rigid plate or member to move relative to the shaft which causes shear in the viscoelastic material. However, such devices suffer from the disadvantage that they are limited to damping only those modes of vibration which have their high modal strain energies at the location of the device and are not suitable for reducing unwanted vibration over wide frequency ranges such as encountered by the ball impact on the golf club. Also, such devices are limited in their application to golf clubs due to the added weight of the rigid member. More specifically, the number of modes of the vibration generated in the golf club is a function of the length of the shaft, among other things. In order to damp most of the undesirable modes that may be created in a golf club, the rigid member must be employed over a substantial portion of the length of the shaft which is unacceptable due to the weight added to the club shaft by the use of the rigid member. Thus, there is a need in the art for a vibration damping device which is light weight, inexpensive and yet can damp resonant vibrations over wide frequency ranges.

SUMMARY OF THE INVENTION

It is, therefore, one object of the present invention to provide a golf club having a vibration damping device.

To achieve the foregoing object, the present invention is a golf club including a club head and a shaft connected to the club head having resonant frequencies over a predetermined range. The golf club also includes a rod disposed within the shaft and a viscoelastic material interposed between the shaft and the rod. The rod is flexible and has resonant frequencies over the same frequency range as the shaft such that the shaft and rod vibrate out of phase with respect to each other and deform the viscoelastic material to damp vibrations in the shaft.

In addition, the present invention is also a method of making a golf club having a vibration damping device including the steps of disposing a viscoelastic material about a flexible rod, wrapping an adhesive layer around the viscoelastic material and inserting the flexible rod, viscoelastic material and adhesive layer into a hollow club shaft. The method also includes the steps of expanding the viscoelastic material such that the adhesive layer is disposed against an inner surface to bond the viscoelastic material to the shaft.

One advantage of the present invention is that a golf club is provided having a vibration damping device. Another advantage of the present invention is that the vibration damping device reduces the unwanted vibration over multiple frequencies of the golf club. Yet another advantage of the present invention is that a method is provided for making a golf club having a vibration damping device.

Other objects, features and advantages of the present invention will be readily appreciated as the same becomes better understood after reading the subsequent description when considered in connection with the accompanying drawings.

BRIEF DESCRIPTION OF THE DRAWINGS

FIG. 1 is a perspective view of a golf club having a vibration damping device according to the present invention.

FIG. 2 is a sectional view taken along line 2—2 of FIG. 1.

FIG. 3 is a partial fragmentary perspective view of a portion of the golf club having the vibration damping device of FIG. 1.

FIG. 4 is a schematic fragmentary view of the golf club having the vibration damping device of FIG. 1 and illustrating a flexible rod of the vibration damping device out of phase with a shaft of the golf club to damp vibrations therein.

FIG. 5 is a graph of compliance versus frequency for a shaft of a golf club without the vibration damping device of FIG. 1.

FIG. 6 is a graph of compliance versus frequency for a flexible rod of the golf club having the vibration damping device of FIG. 1.

FIG. 9 is a partial fragmentary perspective view of a portion of another golf club having a vibration damping device according to the present invention.

FIG. 10 is a sectional view taken along line 10—10 of FIG. 9.

DESCRIPTION OF THE PREFERRED EMBODIMENT(S)

Figure 7:
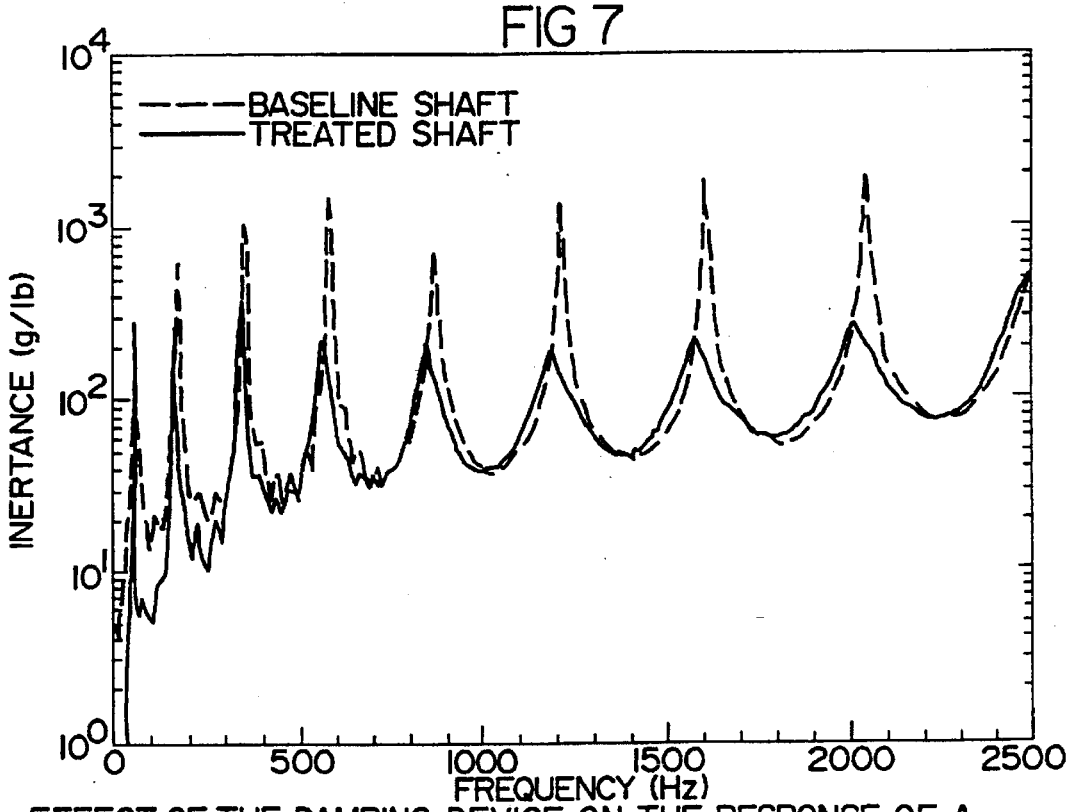
FIG. 7 is a graph of inertance versus frequency for the golf club having the vibration damping device of FIG. 1.

Referring to FIG. 1, one embodiment of a golf club having a vibration damping device, according to the present invention, is generally shown at 10. The golf club 10 includes a golf head 12 having a club face 14 which is used to strike a stationary golf ball in the game of golf. While the club head 12 illustrated in FIG. 1 is of the type known as a "wood", it should be appreciated that the golf club could also be of any type of club, such as a "iron" or a "putter".

The golf club 10 also includes a shaft 16 connected to the club head 12 and having a predetermined length and resonant frequencies over a predetermined range. The shaft 16 is hollow and may be manufactured from a variety of materials commonly known in the art. The shaft 16 has a grip 18 at its end opposite the club head 12 which is grasped by the golfer during play. It should be appreciated that the shaft 16 is a one-piece tubular member. Referring to FIGS. 2 through 4, a rod 20 is disposed within the shaft 16 and a viscoelastic material 22 is interposed between the shaft 16 and the rod 20. The rod 20 is a hollow, flexible, thin walled tubular member disposed substantially concentrically with respect to the shaft 16. The rod 20 is flexible and tuned to have resonant frequencies over the same frequency range as the shaft 16 (see FIGS. 5 and 6) such that the shaft 16 and rod 20 vibrate out of phase with respect to each other and deform the viscoelastic material 22.

The rod 20 has a modulus of elasticity between $10^5$ to $10^7$ psi with a wall thickness of between 0.01 and 0.05 inches. Preferably, the rod 20 is made of plastic tubing for its low weight properties, but its modulus, thickness, and length are chosen in such a way to have its resonances occur over the same frequency range as those of the shaft 16. The viscoelastic material 22 is preferably made of a high damping foam material or other suitable high damping material with rubber like behavior. It should be appreciated that any suitable low modulus and low density viscoelastic material may be used which has good damping behavior over the temperature and frequency ranges of operation.

Figure 8:
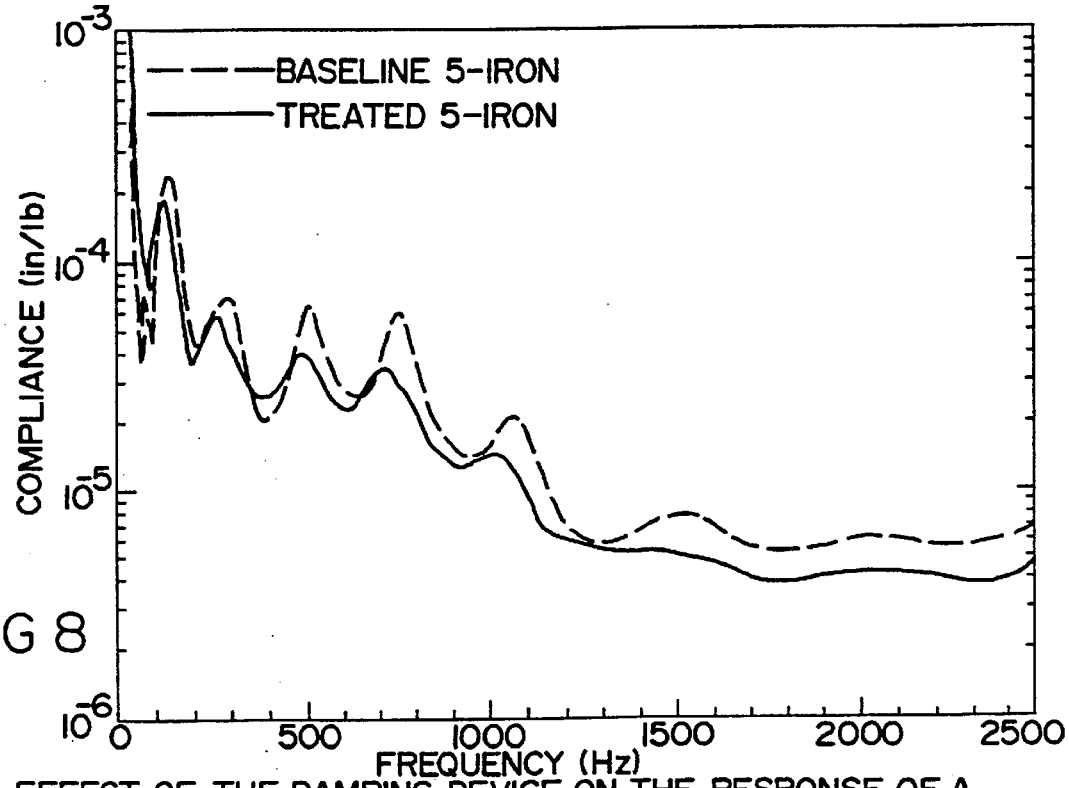
FIG. 8 is a graph of compliance versus frequency for the golf club having the vibration damping device of FIG. 1.

As illustrated in FIGS. 7 and 8, the effect of the vibration damping device in reducing the response of the golf club 10 in both free and hand-held conditions are shown over a wide frequency range. FIG. 7 shows an untreated or baseline shaft and a treated shaft having a vibration damping device within the shaft 16 in a free-free configuration. The inertance (g/lb) is less for the treated shaft then the baseline shaft over a wide frequency (Hz) range. FIG. 8 shows a hand-held configuration. The compliance (in/lb) is less for the treated shaft than the baseline shaft over a wide frequency (Hz) range.

The rod 20 and the viscoelastic material 22 extend a predetermined distance along the length of the shaft 16 corresponding to the frequency range of vibrations to be damped such that multiple frequencies may be damped over a predetermined range. The golf club 10 further includes an adhesive layer 24 interposed between the viscoelastic material 22 and the shaft 16 to bond the viscoelastic material 22 to the shaft 16. In one embodiment, the adhesive layer 24 is a sheet of adhesive wrapped about the viscoelastic material 22 and, more specifically, is a shrink wrap adhesive sheet which is wrapped about the viscoelastic material 22 for bonding it to the shaft 16.

Additionally, a method, according to the present invention, of making the golf club 10 having the vibration damping device is provided. The method includes the steps of disposing the viscoelastic material 22 about an outer surface of the rod 20 such that the rod 20 and the viscoelastic material 22 form a diameter greater than an inner diameter of the shaft 16 of the golf club 10. The method further includes the step of wrapping the adhesive layer 24 around the viscoelastic material 22 such that the diameter of the rod 20, viscoelastic material 22 and adhesive layer 24 is smaller than the inner diameter of the shaft 16 of the golf club 10. The method also includes the steps of inserting the rod 20 and the viscoelastic material 22 and the adhesive layer 24 into the shaft 16 and expanding the viscoelastic material 22 such that the adhesive layer 24 is disposed against the inner diameter of the shaft 16 to bond the viscoelastic material 22 to the shaft 16.

The step of bonding the viscoelastic material 22 to the shaft 16 also includes the step of melting the adhesive layer 24 to bond the viscoelastic material 22 to the shaft 16. More specifically, the step of expanding the viscoelastic material 22 and melting the adhesive layer 24 include the steps of heating the shaft 16 to a predetermined temperature such that the viscoelastic material 22 expands and the adhesive layer 24 is pressed against the inside surface of the shaft 16 and thereby melted to bond the viscoelastic material 22 to the shaft 16.

An alternative method of bonding the viscoelastic material 22 to the inside surface of the shaft 16 is to apply a liquid base adhesive (such as water base adhesive) to the viscoelastic material 22 and slide the vibration damping device inside the shaft 16 before the liquid base adhesive has cured. Time and/or temperature will cause the liquid to evaporate and the adhesive to cure in place and bond the device inside the shaft 16.

Referring to FIGS. 9 and 10, another embodiment of a golf club having a vibration damping device, according to the present invention, is generally shown at 110. Like parts of the golf club 10 have like reference numerals increased by one hundred (100). The golf club 110 has the viscoelastic material 122 spiral wrapped around the rod 120. The rod 120 is a hollow, flexible thin wall tubular member made of hollow plastic tubing. The viscoelastic material 122 is a soft foam material which possess high damping properties. The width, thickness and number of wraps of the viscoelastic material 122 is selected based on the length, thickness and diameter of the rod 120. It should be appreciated that a space 123 exists axially between wraps of the viscoelastic material 122 about the rod 120.

In operation, the rod 120 and viscoelastic material 122 extend a predetermined distance and are located or centered near a mid-point of the shaft 116. As the numerous bending modes of the shaft 116 are excited due to a typical ball impact, the shaft 116 deforms. As the shaft 116 deforms, it causes the rod 120 to deform, which in turn, deforms the viscoelastic material 122 and dissipates vibrational energy in the form of heat in the viscoelastic material 122. The golf club 110 further includes an adhesive layer 124 disposed between the viscoelastic material 122 and the shaft 116 to bond the viscoelastic 122 to the shaft 116. In one embodiment, the adhesive layer 124 is a polymer-based pressure sensitive adhesive such as an acrylic-based, water or solvent soluble, pressure sensitive adhesive.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A golf club having a vibration damping device comprising:

a club head;

a shaft connected to said club head having resonant frequencies over a predetermined range; and a hollow rod disposed within and detached from said shaft and a viscoelastic material interposed between said shaft and said rod and being spiral-wrapped around said rod, said rod and said viscoelastic material extending a predetermined distance along a length of said shaft and being separate from said club head, said rod being flexible and having resonant frequencies over the same frequency range as said shaft such that said shaft and rod vibrate out of phase with respect to each other and deform said viscoelastic material to damp viscoelasticly vibrations in said shaft.

2. A golf club as set forth in claim 1 wherein said shaft has a predetermined length, said rod and said viscoelastic material extending a predetermined distance and centered near a mid-point of said predetermined length of said shaft.

3. A golf club as set forth in claim 1 wherein said viscoelastic material is spiral wrapped around said rod.

4. A golf club as set forth in claim 1 further including an adhesive layer interposed between said viscoelastic material and said shaft to bond said viscoelastic material to said shaft.

5. A golf club as set forth in claim 4 wherein said adhesive layer is a polymer-based pressure sensitive adhesive.

6. A golf club as set forth in claim 5 wherein said polymer-based pressure sensitive adhesive is an acrylic-based, water or solvant soluble, pressure sensitive adhesive.

7. A golf club as set forth in claim 1 wherein said rod is made of plastic tubing.

8. A golf club as set forth in claim 1 wherein said viscoelastic material is made of a soft foam material.

9. A golf club having a vibration damping device comprising:

a club head;

a grip;

a shaft extending between said club head and said grip and having resonant frequencies over a predetermined range;

a hollow rod disposed within and detached from said shaft;

a viscoelastic material spiral-wrapped around said rod;

an adhesive layer disposed between said viscoelastic material and said shaft to bond said viscoelastic material to said shaft; and said shaft having a predetermined length, said rod being flexible and having resonant frequencies over the same frequency range as said shaft, said rod and viscoelastic material extending a predetermined distance and centered near a mid-point of said predetermined length of said shaft and being separate from said club head and corresponding to the frequency range of vibrations to be damped such that said shaft and rod vibrate out of phase with respect to each other and deform said viscoelastic material to damp viscoelasticly multiple frequencies of vibrations over a predetermined range.

10. A golf club as set forth in claim 9 wherein said rod is made of plastic tubing.

11. A golf club as set forth in claim 9 wherein said viscoelastic material is made of a soft foam material.

12. A golf club as set forth in claim 9 wherein said adhesive layer is a polymer-based pressure sensitive adhesive.

13. A golf club as set forth in claim 12 wherein said polymer-based pressure sensitive adhesive is an acrylic-based, water or solvant soluble, pressure sensitive adhesive.

14. A method of making a golf club having a vibration damping device comprising the steps of:

disposing a viscoelastic material about a flexible rod;

disposing an adhesive about the viscoelastic material;

inserting the flexible rod, viscoelastic material and adhesive into a shaft of the golf club; and disposing the adhesive against an inner surface of the shaft and bonding the viscoelastic material to the shaft.

15. A method as set forth in claim 14 including the step of melting the adhesive to bond the viscoelastic material to the shaft.

16. A method as set forth in claim 14 wherein said step of disposing a viscoelastic material about a flexible rod comprises spiral wrapping a viscoelastic material about a flexible rod.

17. A method as set forth in claim 14 including the steps of wrapping the adhesive about the viscoelastic material and heating the shaft to a predetermined temperature such that the viscoelastic material expands and the adhesive is disposed against the inner surface of the shaft and melted to bond the viscoelastic material to the shaft.

* * * * *

UNITED STATES PATENT AND TRADEMARK OFFICE

CERTIFICATE OF CORRECTION

PATENT NO. : 5,655,975

DATED : August 12, 1997

INVENTOR(S) : Ahid D. Nashif

It is certified that error appears in the above-indentified patent and that said Letters Patent is hereby corrected as shown below:

Title page, and in Column 1, line [54], "GOLD" should be --GOLF--.

Signed and Sealed this

Sixteenth Day of December, 1997

Bruce Lehman

*Attest:*

BRUCE LEHMAN

*Attesting Officer*

*Commissioner of Patents and Trademarks*